United States Patent [19]

Dill

[11] 4,406,337

[45] Sep. 27, 1983

[54] INSERT WITH LOCKING PROJECTION

[75] Inventor: Herbert C. Dill, Houston, Tex.

[73] Assignee: Hughes Tool Company, Houston, Tex.

[21] Appl. No.: 249,583

[22] Filed: Mar. 31, 1981

[51] Int. Cl.[3] ..... E21B 10/16; E21B 10/52

[52] U.S. Cl. ..... 175/410; 175/374

[58] Field of Search ..... 175/374, 410; 279/93, 279/103, 104; 407/102, 120; 408/144, 145; 76/101 E, DIG. 11

[56] References Cited

U.S. PATENT DOCUMENTS

| | | | |
|---|---|---|---|
| 1,053,709 | 2/1913 | Collins | 279/103 |
| 2,081,302 | 5/1937 | Jarvis | 175/410 |
| 3,581,835 | 5/1969 | Stebley | 175/409 |
| 3,599,737 | 8/1971 | Flecher | 175/374 |
| 3,693,736 | 9/1972 | Gardner | 175/410 |
| 3,749,190 | 7/1973 | Shipman | 175/374 |
| 3,858,671 | 1/1975 | Kita et al. | 175/410 |
| 4,073,354 | 2/1978 | Bowley et al. | 175/329 |
| 4,176,725 | 12/1979 | Shields | 175/374 |
| 4,199,035 | 4/1980 | Thompson | 175/410 |

*Primary Examiner*—James A. Leppink
*Assistant Examiner*—Hoang C. Dang
*Attorney, Agent, or Firm*—Robert A. Felsman; James E. Bradley

[57] ABSTRACT

A cutting element insert for an earth boring bit has one or more small projections formed on its bottom. The projections are offset from the axis of the insert. When the insert is pressed into the hole in the supporting structure of the bit, the projections will embed into the bottom of the hole to help retain the insert against rotation.

4 Claims, 4 Drawing Figures

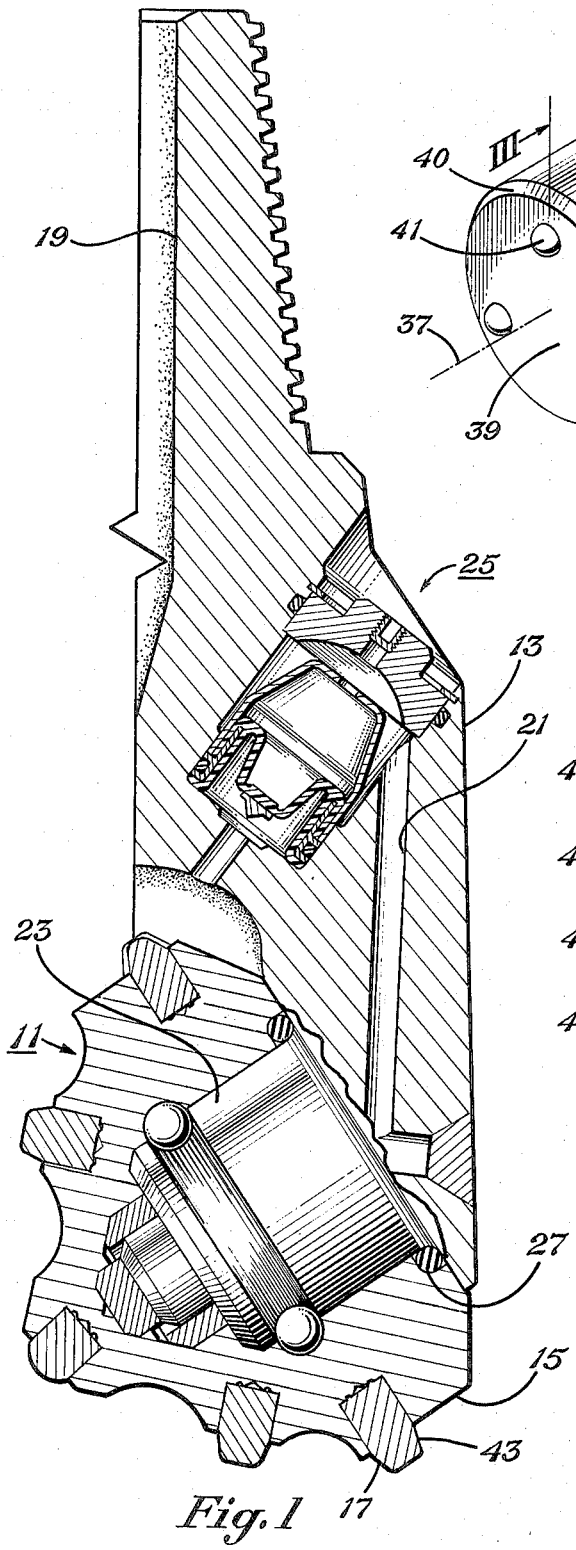
Fig. 1
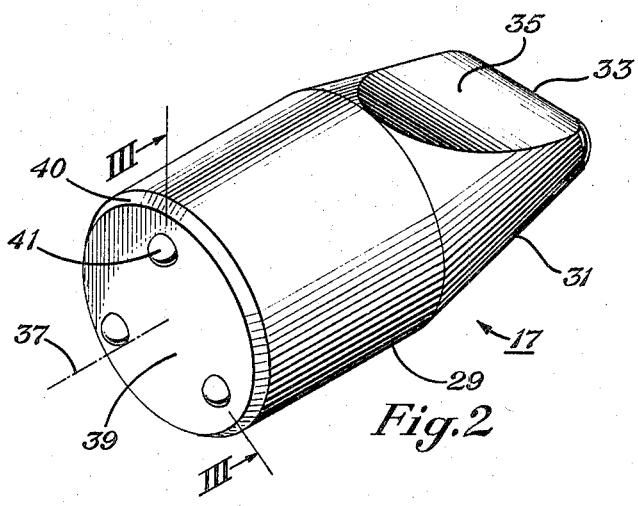
Fig. 2
Fig. 3
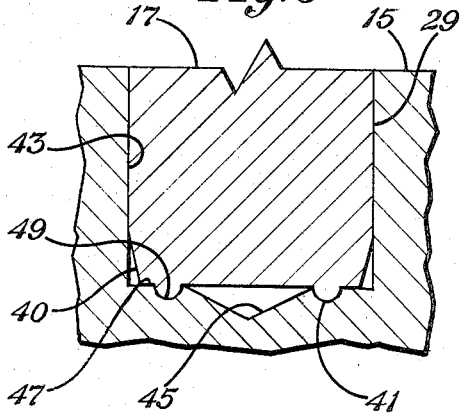
Fig. 4
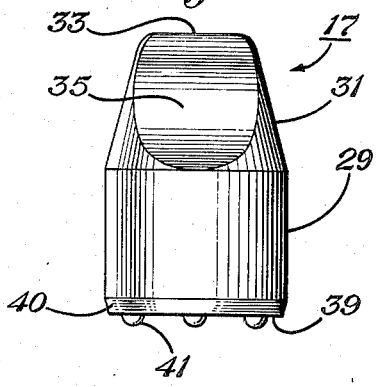

INSERT WITH LOCKING PROJECTION

BACKGROUND OF THE INVENTION

This invention relates in general to earth boring bits and in particular to an insert with improved means for preventing rotation in its receptacle.

Earth boring tool bits include those which have tungsten carbide inserts interferingly retained in mating holes or receptacles in a supporting structure of the bit. The cutting tip or protruding end of the insert serves to crush and disintegrate the earth formation. The supporting structure for the inserts is normally a head or conical cutter of steel. Holes are drilled and reamed in the exterior surface of the supporting structure. The inserts are then pressed into the holes with an interference fit.

While successful, the large forces imposed on the inserts tend to cause the inserts to rotate in their holes. In the case of a specially shaped insert, such as a chisel-shaped insert, the insert will become less effective if it is turned from its proper orientation.

The tight interference fit is the main means by which the inserts are kept from rotating. In U.S. Pat. No. 3,581,835, issued to Frank E. Stebley, Mar. 28, 1972, grooves or flutes are formed on the sidewall of the insert to prevent rotation. Another proposal, shown in U.S. Pat. No. 4,199,035, issued to Donald A. Thompson, on Apr. 22, 1980, teaches the use of a dowel or locating pin for locking the insert to the supporting structure.

SUMMARY OF THE INVENTION

In this invention, the insert is formed with one or more projections or protuberances on the bottom. These projections are offset from the longitudinal axis of the insert for embedding into the supporting structure at the bottom of the receptacle or hole that retains the insert. When the insert is pressed into the hole, its harder metal will deform the supporting structure at the bottom of the hole to lock the insert against rotation. The deformation of the supporting structure metal requires the insert to move upwardly before it could rotate.

BRIEF DESCRIPTION OF THE DRAWINGS

FIG. 1 is a partial, vertical sectional view of an earth boring bit having inserts constructed in accordance with this invention.

FIG. 2 is an enlarged perspective view of one of the inserts of FIG. 1.

FIG. 3 is a sectional view of one of the inserts of FIG. 1, taken along the lines III—III of FIG. 2.

FIG. 4 is a side view of one of the inserts of FIG. 1.

DESCRIPTION OF THE PREFERRED EMBODIMENT

The numeral 11 in FIG. 1 of the drawings designates a lubricated, rotatable cutter-type earth boring drill bit. Drill bit 11 has a body 13 formed in three sections and subsequently welded. Each of the sections supports a rotatable cutter 15 having earth disintegrating inserts 17. The drill bit has an axial fluid passage 19 extending through the body, with usually three nozzles (not shown) at the lower end of the body for discharging drilling fluid against the borehole bottom. Passages 21 supply lubricant to the bearing means 23 between the cutter 15 and its supporting shaft. A pressure compensator system 25 helps provide lubricant through the passages 21 to the bearing means 23, and limits the pressure differential across seal 27.

Referring to FIG. 2, each insert 17 is formed of sintered tungsten carbide in the desired shape in a pressing mold. The sintered tungsten carbide is cemented with a binder. Cobalt in a percentage of 10% to 16% is the most common binder. The exact composition depends upon the usage intended for the tool and its inserts. The completed insert 17 is considerably harder than the supporting metal of cutter 15.

Referring to FIGS. 2 and 4, each insert has a cylindrical base 29. A cutting lip 31 is integrally formed with the base 29. Cutting tip 31 may be of several different shapes, such as ovoid, ogive, or various chisel shapes. The insert shown in the drawings is a chisel-shaped insert, having a crest 33 with flat flanks 35 on each side extending from the crest 33 to the top of base 29. Base 29 has a longitudinal axis 37 that passes through the center of crest 33. Base 29 has a bottom 39 that is normal to axis 37. A bevel 40 is forward at the intersection of the sidewalls of base 29 and bottom 39.

Bottom 39 is flat and smooth, but for a plurality of discontinuities comprising projections or protuberances 41 integrally formed on the bottom. In the preferred embodiment, three projections 41 are located 120 degrees apart and offset from the axis 37. Each projection 41 is located at a point that is closer to the bevel 40 than to axis 37. In the preferred embodiment, each projection 41 is hemispherical, with a diameter that is much less than the diameter of base 29. For example, a 9/16 inch diameter insert 17 might have projections that are 1/16 inch in diameter.

Referring to FIG. 3, each insert 17 is located in a receptacle or hole 43 formed in the cutter 15, with a depth the same as the height of insert base 29. The diameter of hole 43 is slightly less than the diameter of base 29, so as to create an interference fit. Tolerances of the inserts 17 and holes 43 enable the interference to vary normally in a range from about 0.001 to 0.0028 inch. The drilling and reaming of hole 43 results in a conical depression 45 remaining in the bottom of the hole. An annular flat region 47 surrounds the conical depression 45 and is located in a plane that is normal to the axis of the hole 43.

When the insert 17 is pressed into hole 43, projections 41 will contact the flat region 47 and deform this portion of the bottom of the hole. The normal force used in pressing the insert into hole 43 will cause each projection 41 to embed and create a mating depression 49 in the flat region 47 at the bottom of the hole. Insert bottom 39 will contact the bottom of hole 43.

In operation, bit 11 will be secured to the end of a string of drill pipe (not shown). The drill pipe is rotated to rotate the bit. Each cutter 15 will rotate on its axis. The insert 17 will repeatedly engage the bottom of the borehole to disintegrate, chip and abrade the earth formation. The projections 41, embedded into the bottom of each insert hole 43, serve as means for preventing the inserts from rotating within their holes. The depressions 49 and projections 41 would require the insert 17 to move upward from flat region 47 before any rotation could take place.

The invention has significant advantages. The projections on the bottom of the inserts should effectively serve to prevent rotation of the inserts in their holes. This type of retention means does not add to the complexity of the insert. The projections are formed with the insert in the mold. The installation method will be the same as used previously.

While the invention has been shown in one of its forms, it should be apparent to those skilled in the art that it is not so limited, but is susceptable to various changes and modifications without departing from the spirit of the invention.

I claim:

1. A method of mounting an earth disintegrating insert in a hole with a bottom in the supporting structure of an earth boring bit, comprising in combination:

providing the insert with a protuberance on the bottom of the insert;

pressing the insert into the hole and the protuberance into the bottom of the hole at a force sufficient to deform the bottom of the hole and create a depression that receives the protuberance.

2. A method of mounting an earth disintegrating insert in the supporting structure of an earth boring bit, comprising in combination:

providing the insert with a base with a bottom and an integral protuberance protruding from the bottom offset from the longitudinal axis of the insert;

forming a hole in the supporting structure of diameter selectively smaller than the insert and a bottom with a flat region; and pressing the insert into the hole and the protuberance into the flat region at a force sufficient to deform the supporting structure and create a depression that receives the protuberance.

3. A method of providing an earth boring bit with an earth disintegrating element, comprising:

molding with sintered tungsten carbide an insert base with a bottom and a protuberance protruding from the bottom offset from the longitudinal axis of the insert;

forming a hole in supporting metal of diameter selectively smaller than the insert and a bottom with a flat region; and pressing the insert into the hole and the protuberance into the flat region until the bottom of the insert contacts the flat region of the hole, the protuberance deforming the supporting metal and creating a depression that receives the protuberance.

4. In an earth boring bit of the type having a supporting structure adapted to be secured to the end of a string of drill pipe, the supporting structure having a plurality of holes formed in its surface, each hole having a cylindrical sidewall and a bottom with a flat region, the bit further having an earth disintegrating insert for each of the holes, at least some of the inserts comprising:

a base integrally joined to a cutting tip, the base having sidewalls that interferingly mate with the sidewalls of the hole, the base having a bottom with a smooth surface but for at least one discontinuity integrally formed at a location offset from the longitudinal axis of the base and located in a deformation in the flat region of the hole caused by the discontinuity when the insert was pressed into the hole.

* * * * *